United States Patent [19]

van der Veen et al.

[11] Patent Number: 4,480,569

[45] Date of Patent: Nov. 6, 1984

[54] CONTAINER FOR GROUND MATERIAL REMOVED BY A GROUND WORKING DEVICE FROM THE BOTTOM OF A WATERCOURSE

[76] Inventors: Abraham van der Veen, No. 4, Bergpad, 7731 BE Ommen; Jelle van der Veen, No. 33, De Himmen, 8618 NP Oosthem, both of Netherlands

[21] Appl. No.: 457,470

[22] Filed: Jan. 12, 1983

[51] Int. Cl.[3] ..... B63C 11/00

[52] U.S. Cl. ..... 114/74 T; 114/257; 114/321; 114/256; 114/244; 37/56; 15/1.7

[58] Field of Search ..... 37/56; 15/1.7; 141/10, 141/325, 67, 68, 326, 114, 313–317; 114/72, 256, 257, 321, 334, 244, 74 T; 137/315, 317, 318

[56] References Cited

U.S. PATENT DOCUMENTS

| | | | |
|---|---|---|---|
| 1,312,356 | 8/1919 | Reid | 114/72 |
| 2,350,883 | 6/1944 | Duttweiler | 114/256 |
| 2,359,366 | 10/1944 | Katcher | 114/74 T |
| 2,371,404 | 3/1945 | Mumford | 114/321 |
| 3,067,712 | 12/1962 | Doerpinghaus | 114/74 T |
| 3,133,443 | 5/1964 | Timmerman et al. | 114/257 |
| 3,412,862 | 11/1968 | Chaplin | 15/1.7 |
| 3,422,478 | 1/1969 | Osborne | 15/1.7 |
| 3,572,129 | 3/1971 | Walthier et al. | 37/56 |
| 3,593,533 | 7/1971 | Washington | 37/56 |
| 3,630,364 | 12/1971 | Johnston | 15/1.7 |
| 3,971,593 | 7/1976 | Porte et al. | 37/56 |
| 4,155,373 | 5/1979 | DiGiovanni | 137/318 |

FOREIGN PATENT DOCUMENTS

| | | | |
|---|---|---|---|
| 365509 | 3/1922 | Fed. Rep. of Germany | 114/256 |
| 1561602 | 3/1969 | France | 114/313 |

*Primary Examiner*—Sherman D. Basinger
*Assistant Examiner*—Patrick W. Young
*Attorney, Agent, or Firm*—Diller, Ramik & Wight

[57] ABSTRACT

The invention relates to a container for the ground material removed by a ground working device, for example, a mud plough or a suction device from the bottom of a watercourse. Such a container is known in the form of a compartment trough moved by the tugboat of the mud plough or the hopper barge. A disadvantage of such a container is that it is heavy and hence transportable only with difficulty while it is expensive and cannot be emptied by a simple procedure. The invention has for its object to obviate these disadvantages and provides to this end a container of the kind set forth in the preamble constructed in the form of a flexible bag that can be connected with the ground working device.

2 Claims, 7 Drawing Figures

Figure 1:
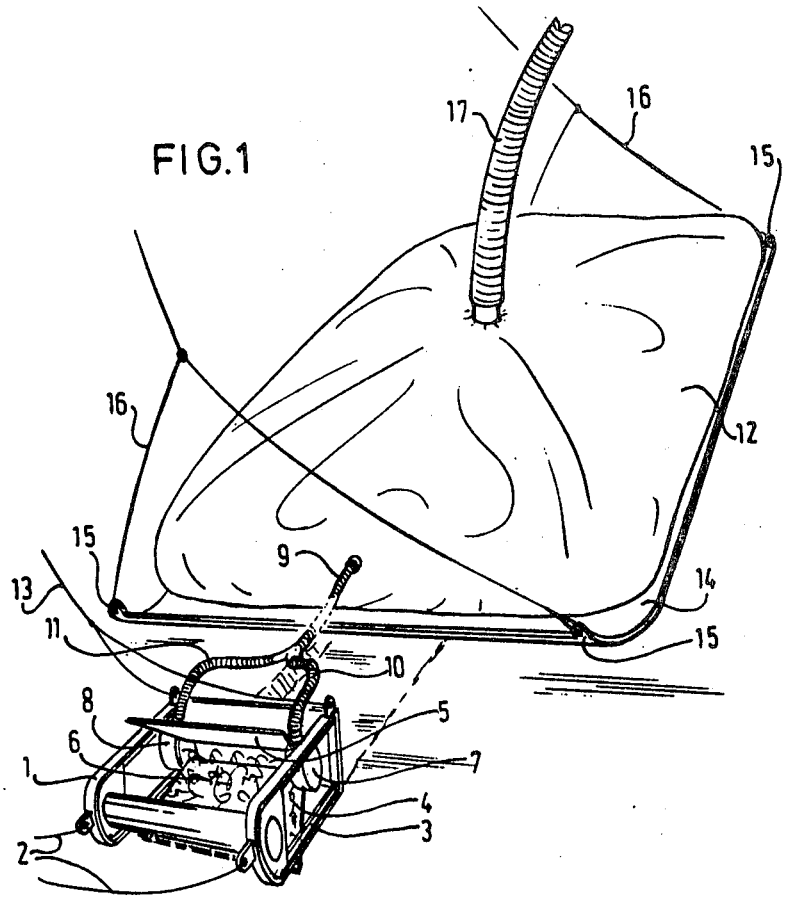

CONTAINER FOR GROUND MATERIAL REMOVED BY A GROUND WORKING DEVICE FROM THE BOTTOM OF A WATERCOURSE

The invention relates to a container for the ground material removed by a ground working device, for example, a mud plough or a suction device from the bottom of a watercourse.

Such a container is known in the form of a compartment trough moved by the tugboat of the mud plough or the hopper barge. A disadvantage of such a container is that it is heavy and hence transportable only with difficulty, whilst it is expensive and cannot be emptied by simple means.

The invention has for its object to obviate these disadvantages and provides to this end a container of the kind set forth in the preamble and being characterized in that the container is connectable to the ground working device and movable therewith under water.

The container is preferably provided with floating means having, for example, an inflatable compartment which can be inflated until, for example, at a given degree of filling, the container freely floats suspended in the water. Thus friction along the bottom is avoided.

It will be obvious that the container according to the invention can be connected with the free space of a sludge plough, where the scraped up ground material is collected, or with the pump means forming part of a hopper dredger.

In order to avoid excessive collection of water the container may be pervious to water.

At the rear end of the container there may be provided an opening that can be closed. This opening may serve to conduct away excess water during operation and/or for emptying the filled container at the place of destination.

The opening can be closed with the aid of an inflatable balloon.

The container according to the invention may furthermore be provided with a slide for gliding along the bottom of a watercourse.

According to the invention further the container can be a flexible bag.

In order for the dimensions of the bag to automatically match the degree of filling, the bag according to the invention can be provided with a tensile spring covering substantially the entire length of the bag and being connected at least by its front and rear ends with the bag. This spring may be formed by a helical spring connected with the bag substantially over its whole length.

The invention furthermore relates to a ground working device, for example, a sludge plough provided with a flexible bag serving as a container for the ground material removed from the bottom.

Figure 2:
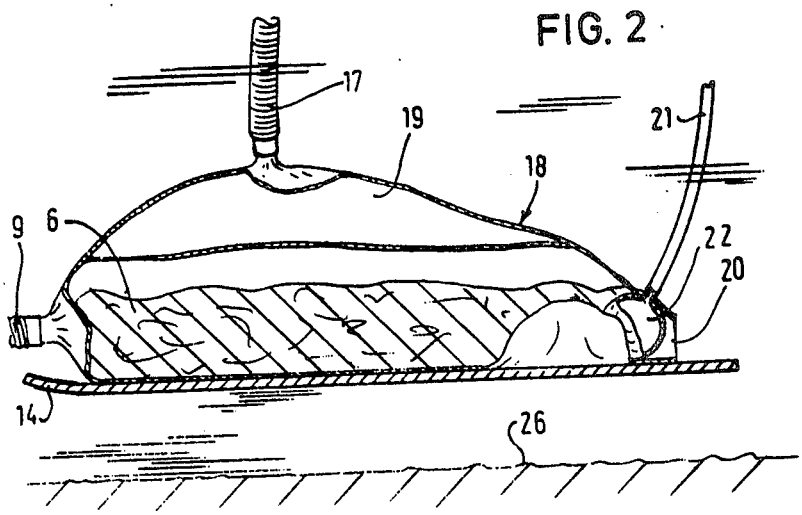
Figure 3:
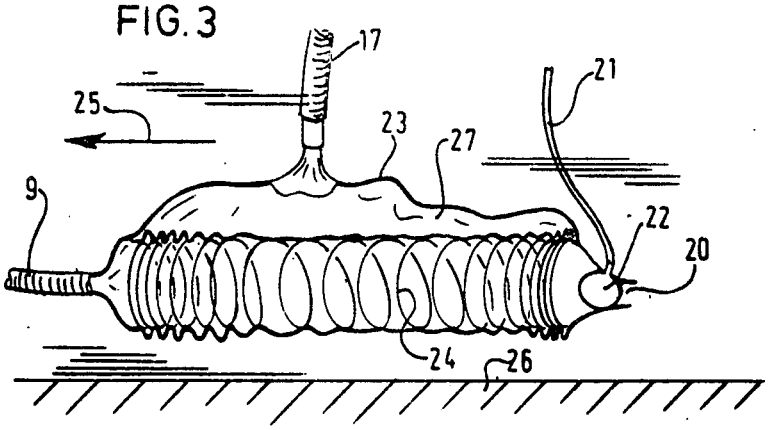
Figure 4:
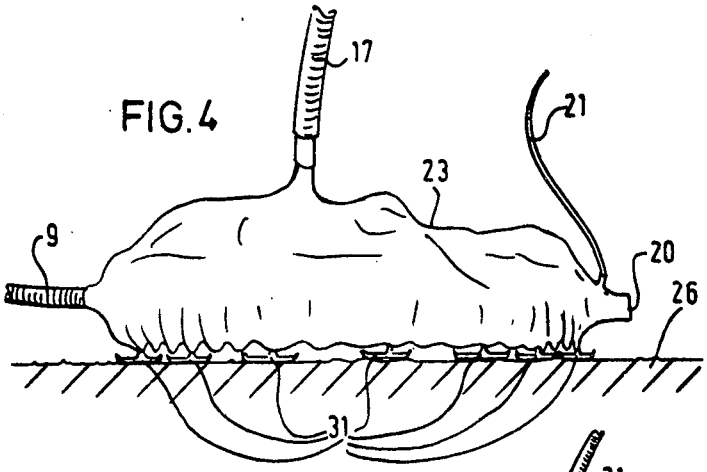
Figure 5:
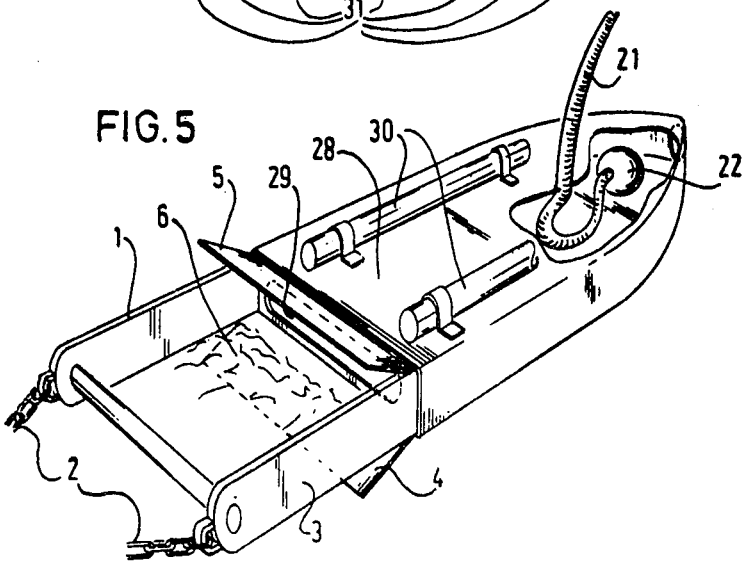
Figure 6:
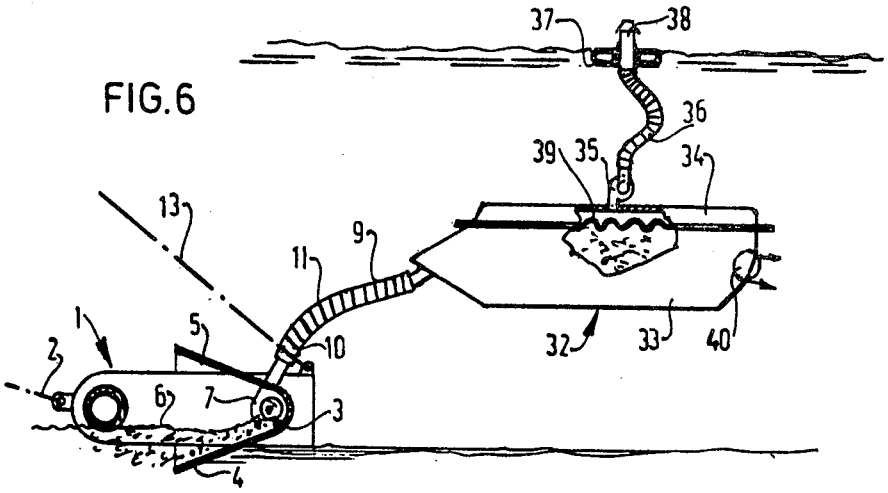
Figure 7:
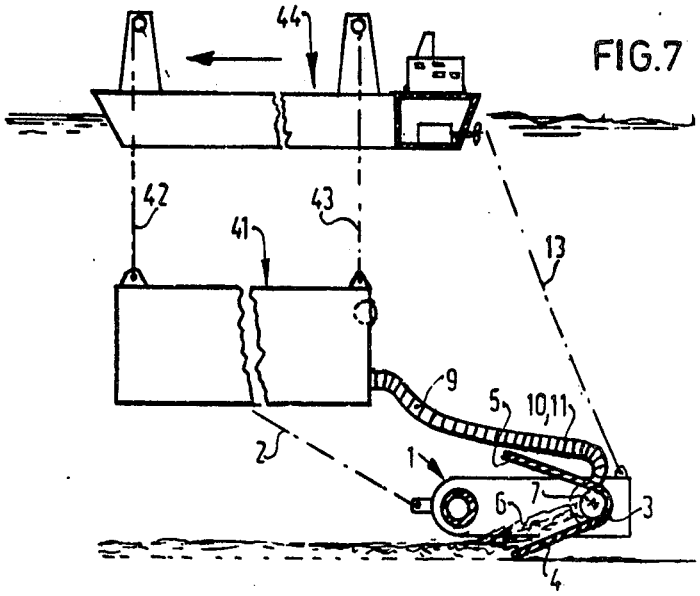

The invention will now be described more fully with reference to a drawing in which the corresponding elements are invariably designated by the same reference numerals. The drawing shows in:

FIG. 1 a perspective view of a first embodiment of a container connected with a sludge plough in accordance with the invention;

FIG. 2 partly a side elevation and partly a cross-sectional view of a second embodiment of the container in accordance with the invention;

FIG. 3 a perspective view, partly broken away, of a third embodiment of the invention;

FIG. 4 a side elevation of a fourth embodiment of the container in accordance with the invention;

FIG. 5 a sludge plough provided with a container in a fifth embodiment of the invention;

FIG. 6 a sludge plough with a container in a sixth embodiment of the invention; and FIG. 7 a sludge plough with a container in a seventh embodiment of the invention.

FIG. 1 shows a sludge plough which can be dragged by means of tow lines 2 along the bottom of a watercourse by a vessel (not shown). The sludge plough 1 comprises a frame 3, to which two plough knives 4, 5 are fastened. The plough knives 4, 5 enclose a space in which ground material 6 loosened from the bottom of the watercourse can accumulate. In this embodiment the ground material 6 is conducted away by means of two pumps 7, 8 fastened to the frame 3 and passing the ground material 6 through hoses 10, 11 merging in one hose 9 to a flexible bag 12.

It is furthermore noted that a further line 13 is fastened to the sludge plough 1, which line when drawn brings about a sloping position of the plough so that the ploughing action can be temporarily stopped.

In this first embodiment the bag 12 is supported by a slide plate 14, which may serve for causing the bag to glide along the bottom. For drawing on and, if necessary, lifting the bag 12 the slide plate 14 is provided at the four corners with ears 15, to which lines 16 are fastened.

In this first embodiment the bag 12 comprises a compartment (not shown) that can be inflated through a compression conduit 17. The supply of compressed air through the conduit 17 can be controlled in a manner such that the bag 12 with the slide plate 14 invariably remains in a completely or substantially completely floating position so that friction at the bottom and hence an impermissibly heavy draught in the tow members concerned are avoided.

FIG. 2 shows a second embodiment of a bag according to the invention. The bag 18 of FIG. 2, like the first embodiment of FIG. 1, comprises an inflatable compartment 19, which can be more or less pressurized through the compression conduit 17. The bag 18 has at its rear end an outlet opening 20 for conducting away accumulated ground material 6 and/or for a more or less regular evacuation of excess water. For this purpose the outlet opening 20 is provided with a closing member formed by a balloon 22 inflatable by means of a compression conduit 21. It will be obvious that by controlling the pressure the dimensions of the balloon 22 and hence the extent of closure of the opening 20 can be controlled. For example, by slightly reducing the pressure it can be ensured that coarse material is retained in the bag 18, whereas finer ground material or excess water is removed from the bag.

FIG. 3 shows a further embodiment of the invention. The bag 23 of this embodiment is provided with a helical spring 24 covering substantially the whole length of the bag and being connected herewith substantially throughout its length. This helical spring ensures that the length of the bag 23 will match the degree of filling.

For completeness' sake the direction of tow is indicated in FIG. 3 by an arrow 25.

Like the bag 18 in FIG. 2, the bag 23 is shown suspended in the water with respect to the bottom 26 in FIG. 3. It should be noted that the bag 23 of FIG. 3 is not provided with one or more slides for the gliding propagation of the bag; the bag 23 has, therefore, to be maintained in the suspended position. For this reason the bag 23 is provided with an inflatable compartment 27.

The embodiment shown in FIG. 4 substantially corresponds with the third embodiment of FIG. 3. It is, however, noted that slide elements 31 are provided by which the bag 23 can also be moved in a more or less gliding state. This variant has the advantage that the bag 23 will not be damaged by friction on the bottom 26 due to lack of floating power and the tow elements concerned will not be overloaded.

In the construction shown in FIG. 5 a rigid container 28 is directly connected with the sludge plough 1 and is communicating through a slot-like opening 29 with the space bounded by the plough knives 4, 5. To the top side of the container 28 are fastened two floats 30.

FIG. 6 shows the sludge plough 1 described already with reference FIG. 1 and with which the hoses 10, 11 and the hose 9 are connected. Hose 9 is connected with a rigid container 32 consisting of a compartment 33 for sludge supplied thereto through the hose and an air compartment 34 connected through a pump 35 and a flexible hose 36 connected therewith to a pipe 38 connected with a float 37 and extending upward, such by energizing the pump the degree of filling with air of the air compartment 34 and in connection therewith the floating ability of the container 32, may be controlled. The compartments 33 and 34 are separated by a diaphragm 39.

The energizing of pump 35 may take place under the influence of the degree of filling with sludge of the sludge compartment 33 in such a way that the container 32 always floats freely in the water.

The drawing shows schematically a closing member 40 closing the sludge compartment 33 during operation and which may be opened for emptying same.

FIG. 7 shows the same sludge plough which, however, in this embodiment is connected with a rigid container 41, which is hung by means of cables 42, 43 under a floating member 44, which according to this present embodiment is also the boat moving the sludge plough 1.

It is noted that the container 41 also may be suspended under a float dragged by a boat.

The invention is not limited to the embodiments described above. For example, the inflatable compartment need not be separated from the space collecting ground material. These two functions may be performed in a single water- and air-tight space. The advantage of the embodiments described above is, however, that there is no risk of losing floating power due to an excessive degree of filling of the bag. In general the container according to the invention serves to collect ground material loosened by a ground working device from the bottom of a watercourse. In the foregoing reference is made to a mud plough, but other devices such as a hopper dredger are also quite suitable for applying the invention.

We claim:

1. An underwater device for collecting material removed from the bottom of a watercourse, said device comprising a flexible bag, a flexible conduit connected to said bag and communicating with the interior thereof, means for discharging a mixture of said material and water through said flexible conduit into said bag whereby said bag becomes increasingly inflated by such mixture, said bag including outlet means for draining water therefrom whereby said bag is progressively inflated by said material, and means for supporting said bag out of contact with said bottom, the means last mentioned comprises a buoyancy compartment in said bag and means for supplying air to inflate said buoyancy compartment so as to compensate for the weight of material collected and buoy said bag above said bottom, means for maintaining said bag in horizontally elongate condition, the means for maintaining comprising a horizontally disposed tensile spring within said bag, the tensile spring covering substantially the whole length of the bag and being connected with the bag at least by its front and rear ends, the tensile spring being a helical spring connected with the bag substantially throughout its length.

2. The device as defined in claim 1 wherein the means last mentioned comprises at least one skid plate.

* * * * *